US005259138A

United States Patent [19]

Scirica

[11] Patent Number: 5,259,138

[45] Date of Patent: Nov. 9, 1993

[54] FIRING MECHANISM BLOCKING SYSTEM

[75] Inventor: Paul A. Scirica, East Hampton, Conn.

[73] Assignee: Colt's Manufacturing Company Inc., West Hartford, Conn.

[21] Appl. No.: 924,197

[22] Filed: Aug. 3, 1992

[51] Int. Cl.[5] ..... F41A 17/72; F41A 19/00

[52] U.S. Cl. ..... 42/70.08; 89/154

[58] Field of Search ..... 42/70.08, 70.01; 89/27.12, 148, 150, 154

[56] References Cited

U.S. PATENT DOCUMENTS

| | | | |
|---|---|---|---|
| 1,972,763 | 9/1934 | Dutton | 42/70.08 |
| 2,169,084 | 8/1939 | Swartz | 89/148 |
| 2,846,925 | 8/1958 | Norman | 42/70.01 |
| 3,633,303 | 1/1972 | Volkmar et al. | 42/70.06 |
| 3,724,113 | 4/1973 | Ludwig | 42/70.08 |
| 3,750,319 | 8/1973 | Roy | 42/70.08 |
| 3,830,002 | 8/1974 | Volkmar | 42/70.08 |
| 3,903,631 | 9/1975 | Vesamaa | 42/70.08 |
| 3,979,850 | 8/1976 | Schiessl et al. | 42/70.08 |
| 4,021,955 | 5/1977 | Curtis | 42/70.08 |
| 4,306,487 | 12/1981 | Beretta | 89/148 |
| 4,312,263 | 1/1982 | Bourlet | 89/154 |
| 4,555,861 | 12/1985 | Khoury | 42/70.08 |
| 4,744,166 | 5/1988 | Mattarelli | 42/69.01 |
| 4,768,302 | 9/1988 | Beretta | 42/70.8 |
| 4,916,843 | 4/1990 | Beretta | 42/70.01 |
| 5,024,139 | 6/1991 | Knight et al. | 89/154 |
| 5,050,480 | 9/1991 | Knight, Jr. et al. | 89/147 |
| 5,081,780 | 1/1992 | Lishness et al. | 42/69.01 |
| 5,105,570 | 4/1992 | Lishness et al. | 42/69.01 |
| 5,157,209 | 10/1992 | Dunn | 42/70.08 |

*Primary Examiner*—David H. Brown

*Attorney, Agent, or Firm*—Perman & Green

[57] ABSTRACT

A safety mechanism for a firearm to prevent the firearm from firing except when the trigger has been moved to a predetermined position. The mechanism includes a plunger and a blocker. The blocker is movably mounted to the slide at a position in front of a striker to prevent the striker from moving forward to strike a cartridge. The plunger is movably mounted to a portion of the frame and is adapted to be moved by the trigger. The plunger, in turn, is adapted to move the blocker to allow a clear path for the striker to move forward to strike a cartridge.

20 Claims, 2 Drawing Sheets

FIG. 3
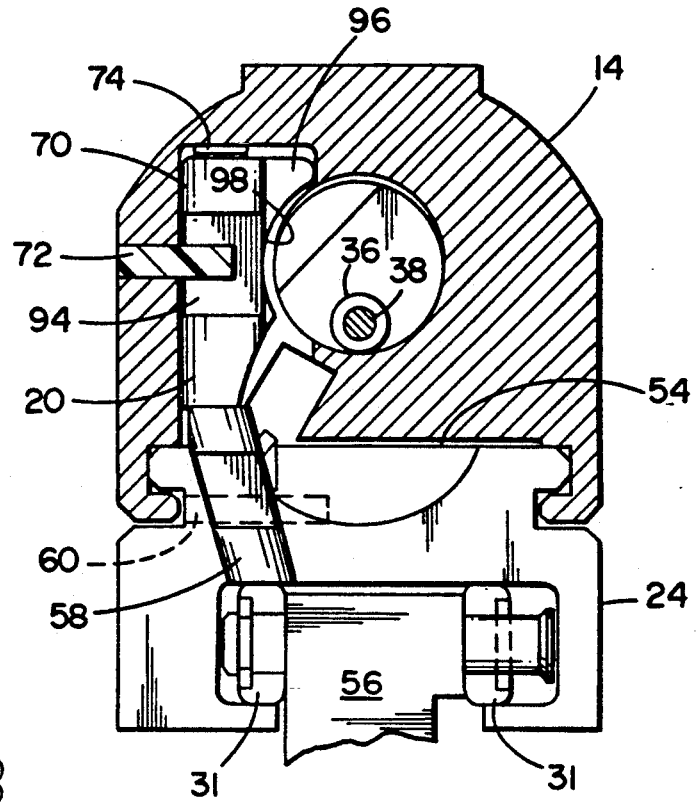
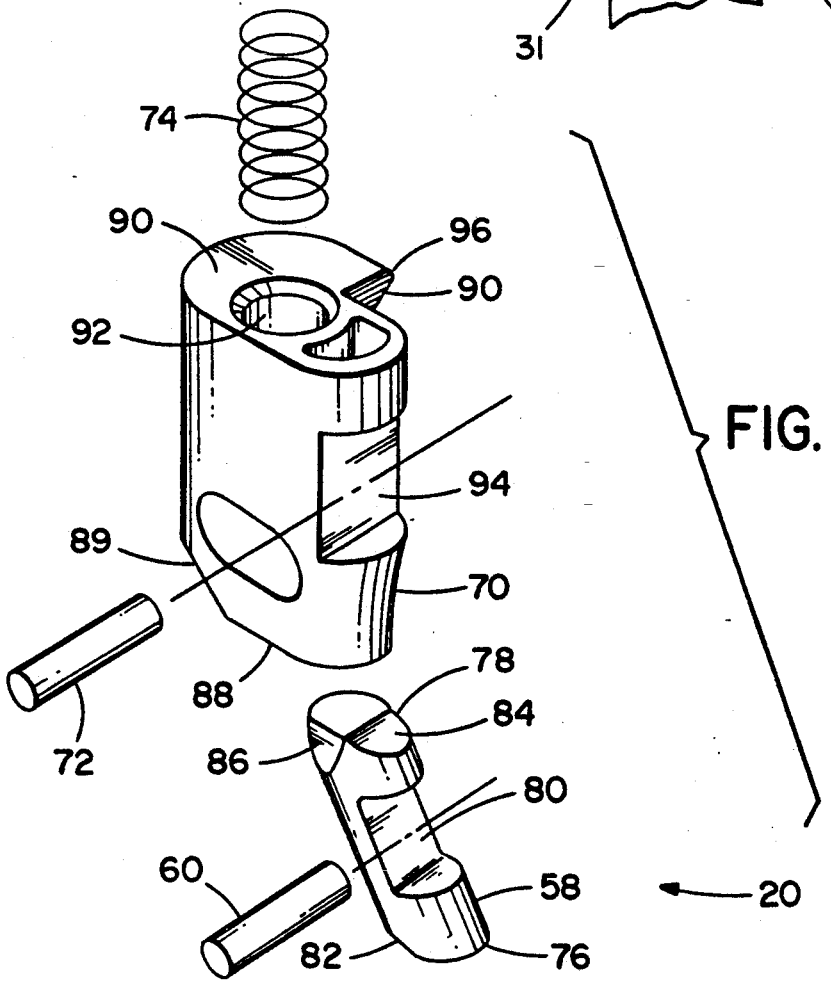
FIG. 4

FIRING MECHANISM BLOCKING SYSTEM

BACKGROUND OF THE INVENTION

1. Field of the Invention

The present invention relates to firearms and, more particularly, to a safety system to prevent inadvertent forward firing pin displacements.

2. Prior Art

Khoury U.S. Pat. No. 4,555,861 discloses a firing pin locking device with a firing pin lock that is moved by activation of the trigger. Swartz U.S. Pat. No. 2,169,084 discloses a firing pin lock with an actuator with a grip safety. Ludwig U.S. Pat. No. 3,724,113 discloses a safety bolt with a pivoted safety lever. Volkmar U.S. Pat. No. 3,830,002 discloses a looking pin for a firing pin. Other U.S. Patents with safety devices include U.S. Pat. Nos. 1,972,763; 2,846,925; 3,633,303; 3,903,631; 3,979,850; 4,021,955; 4,306,487; 4,312,263; 4,744,166; 4,768,302; and 4,916,843.

It is an object of the present invention to provide a new and improved safety device for a firearm.

SUMMARY OF THE INVENTION

Problems are overcome and other advantages are provided by a new and improved firing mechanism blocking system.

In accordance with one embodiment of the present invention, a firearm is provided comprising a frame, a slide, a trigger mechanism, a firing pin mechanism, and means for preventing a striker pin from contacting a cartridge. The slide is movably mounted to the frame. The trigger mechanism is movably mounted to the frame. The firing pin mechanism is movably mounted to the slide and adapted to be moved by the trigger mechanism. The firing pin mechanism includes a case having a front end with a striker pin mounted thereon. The means for preventing can prevent the striker pin from contacting a cartridge unless the trigger mechanism has been actuated. The means for preventing includes a blocker and a plunger. The blocker is movably mounted to the slide and has a laterally extending portion. The blocker is movable between a first position with the laterally extending portion located in a forward path of the case and a second position with the laterally extending portion not in the forward path of the case. The plunger is movably mounted to the frame with a first end adapted to be contacted and moved by the trigger mechanism and a second end contacting the blocker. The plunger is movable by the trigger mechanism to move the blocker from its first position to its second position.

In accordance with another embodiment of the present invention, a firearm is provided comprising a frame, a slide, a trigger mechanism, a firing pin mechanism, and a safety. The slide is movably mounted to the frame. The trigger mechanism is movably mounted to the frame and has a trigger with rollers connected thereto for moving the trigger on the frame. The firing pin mechanism is movably mounted to the slide and has a case with a striker pin at a front end. The safety comprises a plunger and a blocker. The blocker is movably mounted to the slide. The plunger has a first end adapted to be contacted by at least one of the rollers and move thereby, and a second end adapted to move the blocker from a first position in front of the case to a second position not in front of the case.

In accordance with one system of the present invention, a system for preventing unintentional contact of a striker pin with a cartridge in a firearm is provided. The system comprises a plunger and a blocker. The plunger is movably mounted to the frame along a first linear path and has a first end adapted to be contacted by a portion of the trigger assembly and a second end with an angled surface. The blocker is movably mounted to the slide along a second linear path different than the first linear path of the plunger. The blocker has a lateral portion adapted to be moved into and out of a forward path of a portion of the case, and an angled surface contacting the plunger angled surface to provide a smooth sliding movement between the plunger and the blocker when the plunger moves the blocker.

BRIEF DESCRIPTION OF THE DRAWINGS

The foregoing aspects and other features of the invention are explained in the following description, taken in connection with the accompanying drawings, wherein:

FIG. 3 is a schematic partial cross sectional view as in FIG. 2 with the trigger moved to a second position.

FIG. 4 is an exploded perspective view of portions of the safety system shown in FIGS. 1–3.

DETAILED DESCRIPTION OF THE INVENTION

Figure 1:
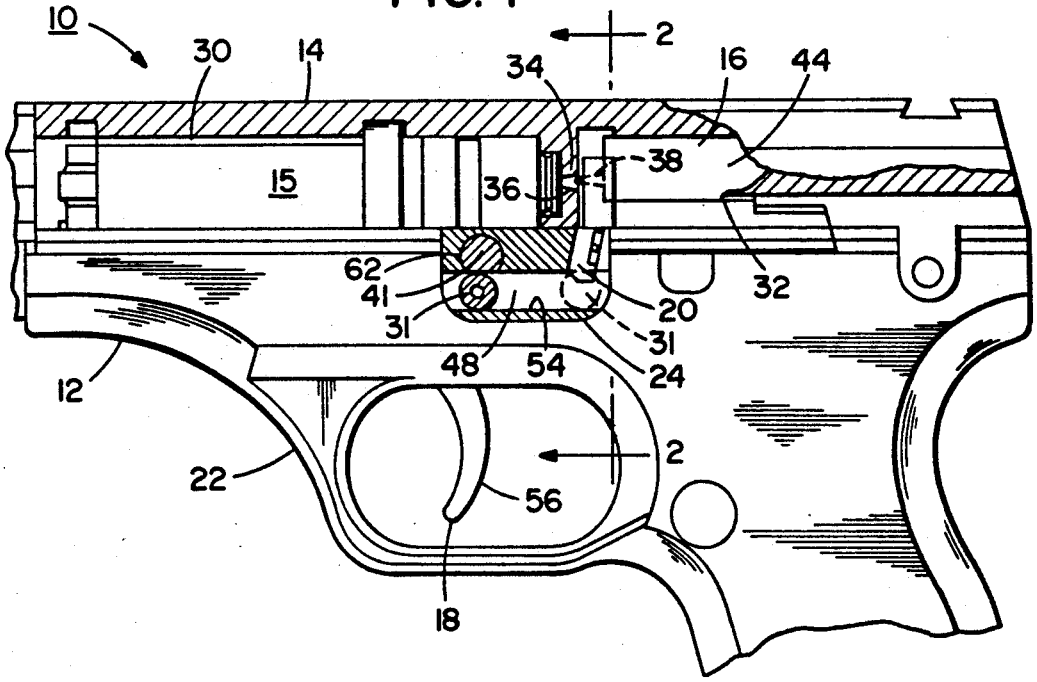
FIG. 1 is a schematic partial cross sectional view of a portion of a pistol incorporating features of the present invention.

Referring to FIG. 1, there is shown a schematic partial cross sectional view of a pistol 10 incorporating features of the present invention. While the following description is with reference to the embodiment shown in the drawings, it should be understood that the present invention is capable of use in various forms, in various types of firearms, and in various methods of use. In addition, any suitable size, shape, or type of elements or materials can be used as will further be understood from the following description.

The pistol 10, in the embodiment shown, generally comprises a frame 12, a slide 14, a firing pin or striker mechanism 16, a trigger mechanism 18, and a safety blocking system 20. A similar pistol is disclosed in U.S. Pat. No. 5,024,139 which is hereby incorporated by reference in its entirety herein. The frame 12 generally comprises a main body 22 and a cam block 24. The cam block 24 is inserted into a receiving space in the main body 22. A similar cam block is disclosed in U.S. patent application Ser. No. 07/628,394 filed Dec. 14, 1990 entitled "Disassembly Control System For A Firearm", (now abandoned) assigned to the same assignee as herein, which is hereby incorporated by reference in its entirety.

Figure 2:
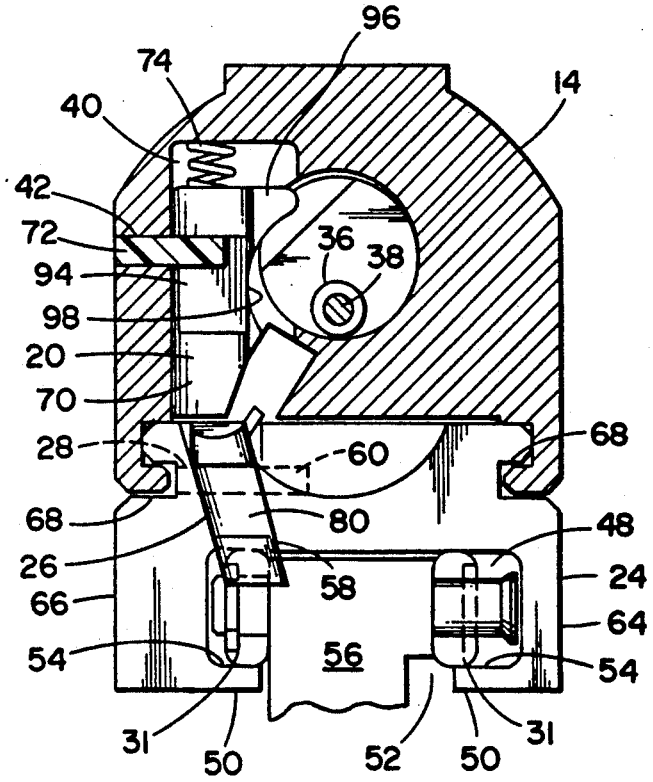
FIG. 2 is a schematic partial cross sectional view of the pistol shown in FIG. 1 taken along the line 2—2.

Referring also to FIGS. 2 and 3, in the embodiment shown, the cam block 24 is comprised of a suitable material such as metal and generally performs four functions. First, the cam block 24 controls axial longitudinal and rotation movement of the barrel 15. Second, the cam block 24 also partially supports the trigger assembly 18. Third, the cam block 24 houses the takedown pin 46 that controls disassembly of the firearm 10. Fourth, the cam block 24 movably houses a plunger 58 of the safety blocking system 20. The main body 22 has a cavity for receiving the block 24; however, in an alternate embodiment of the invention, the cam block 24 may be integrally formed with the main body 22. The cam block 24 has a bottom with a slot 52 into a roller bearing and sear channel 48 that extends the entire length of the cam block 24. The channel 48 has ledges 50 that the two top roller bearings 31 are adapted to roll along. The top surface 54 of the cam block 24 has a cam slot or groove with a front section, a rear section, and is slightly contoured to have the bottom rear portion of the barrel 15 positioned thereon. The rear section is angled relative to the front section and is adapted to movably hold a lug extending from the bottom of the barrel 15 therein. Thus, when the barrel 15 is longitudinally moved relative to the block 24, the rear section causes the barrel to axially rotate. The back wall of the rear section prevents the barrel from moving too far back. The takedown pin 46 is adapted to selectively allow movement of the barrel lug through the front section. A takedown pin hole 62 extends through the block 24 from its first side 64 to its second side 66. The hole 62 transversely intersects the front section of the cam slot. The sides 64 and 66 also contain slide raceways in front of and behind the block 24. The top of the takedown pin hole 62 intersects the bottom of the raceways 68. The cam block 24 also comprises a plunger hole 26 and a retaining pin hole 28. The plunger hole 26 extends from a top of the cam block 24 into the channel 48 above the path of one of the roller bearings 31. The retaining pin hole 28 intersects the plunger hole 26.

The slide 14 is adapted to longitudinally slide on the frame 12 and includes a front cavity 30 for receiving the barrel 15 and a rear cavity 32 for receiving the firing pin mechanism 16. A wall 34 is located between the two cavities with a firing pin aperture 36 such that the firing pin 38 of the firing pin mechanism 16 can pass therethrough and strike the rear of a cartridge. The slide 14 also comprises a blocker hole or channel 40 and a retaining pin hole 42. The retaining pin hole 42 intersects the blocker channel 40, and the blocker channel 40 is located at the front of the rear cavity 32.

The firing pin mechanism or assembly 16 generally comprises a spring unit (not shown), an outer case 44, the firing or striker pin 38 at the front end of the case 44, and a sear (not shown) fixedly connected to the case 44. A similar firing pin assembly is disclosed in U.S. patent application Ser. No. 07/627,595 filed Dec. 14, 1990 entitled "Firing Pin Positioning System" and U.S. patent application Ser. No. 07/628,383 (now U.S. Pat. No. 5,081,780) filed Dec. 14, 1990 entitled "Firing Pin Spring Assembly"(now U.S. Pat. No. 5,105,570), both assigned to the same assignee as herein, which are hereby incorporated by reference in their entireties herein. However, any suitable type of firing pin mechanism could be provided.

The trigger mechanism 18 generally comprises a trigger 56, two sets of roller bearings movably mounting the trigger 56 on the frame 12, and a sear (not shown) pivotally mounted to the trigger 56. A substantially identical trigger assembly is disclosed in U.S. Pat. No. 5,024,139. Movement of the trigger 56 from a forward position to a rear position causes the trigger mechanism sear (not shown) to move the case 44 rearward and release it. The spring unit of the firing pin mechanism 16 then propels the case 44 and striker pin 38 forward such that the pin 38 can contact the rear of a cartridge. The case 44 is normally biased in a home position by a positioning spring (not shown) such that the front of the case 44 is slightly spaced from the wall 34.

Referring also to FIG. 4, an exploded perspective view of the safety blocking system 20 is shown. The system generally comprises a plunger 58, a plunger retaining pin 60, a blocker 70, a blocker retaining pin 72, and a biasing spring 74. The plunger 58 is movably mounted to the cam block 24 in the plunger hole 26 along a first linear path. The plunger 58 has a first end 76, a second end 78, and a retaining notch 80. The first end 76 has a sloped or ramped front 82 which is adapted to be contacted by one of the rollers 31 and moved thereby. The second end 78 has a sloped or ramped rear 84 and angled side 86. The angled side 86 allows the plunger 58 to properly move in the blocker channel 40 and the ramped surfaced 84 is adapted to contact and move the bottom of the blocker 70. The retaining notch 80 is aligned with the retaining pin hole 28 in the cam block 24 and the pin 60 is press-fit inserted into the hole 28 to movably retain the plunger 58 to the cam block 24. However, suitable means to movably mount the plunger 58 in the cam block 24 could be provided.

The blocker 70 generally comprised a bottom 88, a top 90, a spring hole 92, a retainer notch 94 and a laterally extending side portion or extension 96. The bottom 88 has an angled or ramped surface 89 adapted to have the ramped surface 84 of the plunger 58 slide therealong. The top 90 has the spring hole 92 passing therethrough. The spring hole 92 is adapted to hold the bottom of the spring 74. The retainer notch 94 is adapted to be aligned with the regaining pin hole 42 in the slide 14 and the pin 72 is press-fit inserted into the hole 42 to movably retain the blocker 70 to the slide 14. Thus, the blocker 70 can be movably mounted to the slide 14 in the channel 40 along a second linear path, angled relative to the first linear path of the plunger 58. However, any suitable means to movably mount the blocker 70 in the slide 14 could be provided. The side extension 96 has an accommodating curved surface 98 with substantially the same shape as the outer perimeter of the case 44.

The safety blocking system 20 is generally intended to prevent inadvertent forwar striker pin displacements that could cause discharge of a cartridge. As can be seen in FIG. 2, which shows the pistol in a safety blocked position, the blocker 70 is biased in a first down position by the spring 74. The retaining pin 72 limits its downward movement in the blocker channel 40. In this down position, the extension 96 is located in the front path of the case 44. Thus, the extension 96 prevents the case 44 from moving significantly forward thereby preventing the striker pin 38 from moving significantly forward. Hence, the striker pin 38 is prevented from contacting a cartridge, thus preventing discharge of the pistol. In this first position, the blocker 70 pushes the plunger 58 down such that the bottom end 76 of the plunger 58 extends out of the plunger hole 26 into the channel 48. Further downward movement of the plunger is limited by the retaining pin 60 and notch 80.

FIG. 3 shows the safety blocking system 20 in a firing position. In the embodiment shown, actuation of the trigger mechanism 18 controls movement of the safety blocking system 20. Normally, the trigger 56 is biased in the forward position shown in FIG. 1 by a suitable spring and plunger (not shown). In this forward position the top roller bearings 31 are located in the front of the cam block channel 48 with the plunger 58 extending into a rear portion of the channel 48. As the user pulls on the trigger 56, it moves in a rearward direction. The roller bearings 31 move rearward with the trigger in the channel 48. Near the end of the trigger mechanism rearward travel, but before release of the firing pin mechanism 16 by the trigger mechanism 18, one of the roller bearings 31 contacts the front ramped surface 82 of the plunger's bottom end 76. With further rearward movement of trigger mechanism 18, the roller bearing 31 pushes against the ramped surface 82 to push the plunger 58 upward in the plunger hole 26. The shape of the rolling bearing 31 and the shape of the ramped surface 82 allow a smooth relative motion therebetween.

As the plunger 58 is pushed up, its top end 78 pushes on the bottom end 88 of the blocker 70. The blocker 70 is thus moved up in the blocker channel 40 compressing the spring 74. The ramped or angled rear surface 84 of the plunger 58 and ramped or angled surface 89 of the blocker plunger 70 are adapted to slide relative to each other such that relative motion can be compensated for due to the two different angled paths of the plunger 58 and blocker 70. As the blocker 70 is moved up, its extension 96 also moves up such that its accommodating surface 98 is relocated to allow the front of the case 44 to move therepast. This occurs as the roller bearing 31 reaches a position substantially to the rear of the channel 48 as shown in dashed lines in FIG. 1. This is substantially the same time that the trigger mechanism 18 releases the firing pin mechanism 16. Thus, when the firing pin mechanism 16 is released, it propels the case 44 forward to allow the front of the case 44 to pass along or proximate the accommodating surface 98 and, extend the striker pin 38 through the hole 36 to strike a cartridge. After firing, the case is located back to its home position by a positioning spring (not shown).

As the trigger 56 is released by the user, it is biased back towards its forward position thereby moving the top roller bearing 31 from under the plunger 58. The spring 74 is then able to bias the blocker 70 downward towards it blocking position shown in FIG. 2. As the blocker 70 is moved downward, it moves the plunger 58 downward back to its first position. The case 44 is thus once again prevented from moving inadvertently forward. Hence, the pistol is prevented from inadvertently firing.

One of the features of the present invention is that it provides a relatively simple safety between a trigger that moves in a first path of motion and a blocker or safety member that moves in a second path of motion substantially perpendicular to the first path of motion. Another feature is that the system, due to use of the roller bearing 31 and ramped surface 82, provide a smooth relative movement therebetween. Another feature of the present invention is that the shape of the extension 96 allows the movement of the blocker between a first position in front of the case 44 and a second position not located in front of the case to be accomplished relatively quickly and yet still provide a substantial portion of the laterally extending portion in front of the case when the blocker is in its first position. Another feature of the present invention is that the blocker is not moved until the end of the trigger mechanism travel. Another feature of the present invention is that it allows the striker assembly 16 to be moved behind the blocker 70 without interference by the blocker. This can be important because, unlike firearms having hammers, firearms such as that shown in the drawings that do not use a hammer, must have their strikers moved a comparatively long distance or travel before they can obtain enough potential energy to properly hit and discharge a cartridge. By placing a blocking element in front of a striker, as with the embodiment shown in the drawings, allows a similar type of safety as disclosed in U.S. Pat. No. 4,555,861 to now be used in hammerless firearms. It should be understood, however, that the present invention could also be used on hammer-type firearms.

As noted above, although the present invention has been only described with reference to the one embodiment shown in the drawings, the invention is capable of use in various forms, in various types of firearms, and in various methods of use. One alternate embodiment might include a manually actuatable safety selector integrated with the blocking system 20. Other alternate embodiments could also include additional or different parts, shapes of parts, or part configurations.

Let it be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A firearm comprising:

a frame;

a slide movably mounted to the frame;

a trigger mechanism movably mounted to the frame;

a firing pin mechanism movably mounted to the slide and adapted to be moved by the trigger mechanism, the firing pin mechanism including a case having a front end with a striker pin mounted thereon; and means for preventing the striker pin from contacting a cartridge unless the trigger mechanism has been actuated, the means for preventing including a blocker and a plunger, the blocker being movably mounted to the slide and having a laterally extending portion, the blocker being movable between a first position with the laterally extending portion located in a forward path of the case and a second position with the laterally extending portion not in the forward path of the case, the plunger being movably mounted to the frame with a first end adapted to be contacted and moved by the trigger mechanism and a second end contacting the blocker, the plunger being movable by the trigger mechanism to move the blocker from its first position to its second position.

2. A firearm as in claim 1 wherein the means for preventing includes a spring that biases the blocker in the first position.

3. A firearm as in claim 1 wherein the blocker is fixedly, but movably mounted to the slide.

4. A firearm as in claim 1 wherein the blocker laterally extending portion has an accommodating curved surface with substantially the same shape as a portion of the outer perimeter of the case such that movement of the blocker between the first and second positions can be accomplished relatively quickly and still provide a substantial portion of the laterally extending portion in front of the case when the blocker is in its first position.

5. A firearm as in claim 1 wherein the trigger mechanism includes a roller and the plunger is moved by contact with the roller.

6. A firearm as in claim 5 wherein the plunger has a ramp surface at one end to make contact with the roller.

7. A firearm as in claim 1 wherein the frame includes a cam block in which the plunger is movably mounted.

8. A firearm as in claim 7 wherein the plunger is movably mounted in the cam block for movement in a linear path.

9. A firearm as in claim 8 wherein the blocker is movable in a linear path relatively angled to the plunger linear path.

10. A firearm comprising:

a frame;

a slide movably mounted to the frame;

a trigger mechanism movably mounted to the frame, the trigger mechanism having a trigger with rollers connected thereto;

a firing pin mechanism movably mounted to the slide, the firing pin mechanism having a case with a striker pin at a front end; and a safety comprising a plunger and a blocker, the blocker being movably mounted to the slide, the plunger having a first end adapted to be contacted by at least one of the rollers and moved thereby, and a second end adapted to move the blocker from a first position in front of the case to a second position not in front of the case.

11. A firearm as in claim 10 wherein the plunger first end has a ramp shape.

12. A firearm as in claim 10 wherein the plunger and blocker are adapted to slide relative to each other.

13. A firearm as in claim 10 wherein the safety further comprises means for biasing the blocker in the first position.

14. A firearm as in claim 10 wherein the blocker has a side portion adapted to move into and out of the front path of the case with a shaped surface with substantially the same shape as the outer perimeter of the case.

15. A firearm as in claim 10 wherein the frame includes a cam block in which the plunger is fixedly, but movably mounted.

16. A firearm as in claim 10 further comprising means for biasing the case in a first position on the slide such that the blocker can be located, at least partially, in front of the case.

17. A firearm as in claim 10 wherein the safety comprises means for preventing movement of the blocker from the first position until substantially the same time that the trigger mechanism releases the firing pin mechanism.

18. A system for preventing unintentional contact of a striker pin with a cartridge in a firearm, the firearm having a frame, a slide, a trigger assembly, and a firing pin assembly, the firing pin assembly having a case with the striker pin on its front end, the system comprising:

a plunger movably mounted to the frame along a first linear path, the plunger having a first end adapted to be contacted by a portion of the trigger assembly and a second end with an angled surface; and a blocker movably mounted to the slide along a second linear path different than the first linear path of the plunger, the blocker having a lateral portion adapted to be moved into and out of a forward path of a portion of the case, and an angled surface contacting the plunger angled surface to provide a smooth sliding movement between the plunger and blocker when the plunger moves the blocker.

19. A system as in claim 18 wherein the lateral portion has a shaped surface which has substantially the same shape as a portion of the case.

20. A system as in claim 19 further comprising means for biasing the blocker towards a first position in front of the portion of case.

* * * * *